US011791568B2

(12) United States Patent
Xu et al.

(10) Patent No.: US 11,791,568 B2
(45) Date of Patent: Oct. 17, 2023

(54) BI-DIRECTIONAL FLAT PLATE FOLDABLE UNIT AND BI-DIRECTIONAL FLAT PLATE FOLDABLE ANTENNA MECHANISM

(71) Applicant: Yanshan University, Qinhuangdao (CN)

(72) Inventors: Yundou Xu, Qinhuangdao (CN); Bo Chen, Qinhuangdao (CN); Sicheng Lu, Qinhuangdao (CN); Ming Li, Qinhuangdao (CN); Luyao Guo, Qinhuangdao (CN); Xinlu Wei, Qinhuangdao (CN); Jiantao Yao, Qinhuangdao (CN); Qifeng Cui, Qinhuangdao (CN); Yongsheng Zhao, Qinhuangdao (CN)

(73) Assignee: YANSHAN UNIVERSITY, Qinhuangdao (CN)

( * ) Notice: Subject to any disclaimer, the term of this patent is extended or adjusted under 35 U.S.C. 154(b) by 0 days.

(21) Appl. No.: 17/883,669

(22) Filed: Aug. 9, 2022

(65) Prior Publication Data

US 2023/0048276 A1 Feb. 16, 2023

(30) Foreign Application Priority Data

Aug. 10, 2021 (CN) ..... 202110911953.3

(51) Int. Cl.
*H01Q 21/24* (2006.01)
*H01Q 3/01* (2006.01)
*H01Q 21/00* (2006.01)

(52) U.S. Cl.
CPC ..... *H01Q 21/24* (2013.01); *H01Q 3/01* (2013.01); *H01Q 21/0031* (2013.01)

(58) Field of Classification Search
CPC ..... H01Q 1/08; H01Q 1/18; H01Q 19/104; H01Q 1/288; H01Q 21/24; H01Q 3/01; H01Q 21/0031; H01Q 1/1235
See application file for complete search history.

(56) References Cited

U.S. PATENT DOCUMENTS 4,152,708 A * 5/1979 Boucher ..... H01Q 1/08 343/741
4,725,025 A * 2/1988 Binge ..... H01Q 1/08 244/172.6

(Continued)

FOREIGN PATENT DOCUMENTS

CN 109818130 A * 5/2019
CN 110504522 A * 11/2019

(Continued)

OTHER PUBLICATIONS

Su et a., Tolerance Assignment and Optimization of Space Deployable Supporting Structure, 2019, IEEE International Conference on Measuring Technology and Mechatronics Automation (ICMTMA), 111-114 (Year: 2019).*

*Primary Examiner* — Dimary S Lopez Cruz
*Assistant Examiner* — Jordan E. DeWitt
(74) *Attorney, Agent, or Firm* — IPRO, PLLC; Na Xu

(57) ABSTRACT

The present invention discloses a bi-directional flat plate foldable unit, including a first row of antenna plates and a second row of antenna plates distributed along a first direction; the first row of antenna plates and the second row of antenna plates both include three antenna plates distributed in a second direction perpendicular to the first direction, three antenna plates in the first row of antenna plates and three antenna plates in the second row of antenna plates are set opposite to each other and hinged to form a first rotating pair; any two antenna plates adjacent to each other in the same row of antenna plates are hinged to form a second rotating pair; three antenna plates in the first row of antenna plates and three antenna plates in the second row of antenna plates are connected by a vertical support mechanism, and the first row of antenna plates are connected to the second row of antenna plates by a lateral support mechanism. The bi-directional flat plate foldable antenna mechanism (Continued)

includes at least two bi-directional flat plate foldable units mentioned above. The present invention facilitates the folding and unfolding of planar antennas with larger physical diameter and high rigidity.

7 Claims, 7 Drawing Sheets

(56) References Cited

U.S. PATENT DOCUMENTS

| | | | | | |
|---|---|---|---|---|---|
| 5,196,857 | A * | 3/1993 | Chiappetta | H01Q 1/08 | 244/172.6 |
| 5,239,793 | A * | 8/1993 | Chiappetta | E04H 12/185 | 343/915 |
| 5,787,671 | A * | 8/1998 | Meguro | B64G 1/66 | 52/79.5 |
| 6,299,105 | B1 * | 10/2001 | Gilmore | B64G 1/645 | 244/172.6 |
| 2018/0278200 | A1 * | 9/2018 | Jeon | H02S 30/20 | |
| 2020/0203799 | A1 * | 6/2020 | Xu | H01Q 15/161 | |
| 2022/0181787 | A1 * | 6/2022 | Taylor | H01Q 1/288 | |
| 2023/0048276 | A1 * | 2/2023 | Xu | H01Q 1/288 | |

FOREIGN PATENT DOCUMENTS

| | | | | |
|---|---|---|---|---|
| CN | 111509358 | B | * | 5/2021 |
| CN | 113675574 | A | * | 11/2021 |
| JP | 2002335113 | A | * | 11/2002 |

* cited by examiner

BI-DIRECTIONAL FLAT PLATE FOLDABLE UNIT AND BI-DIRECTIONAL FLAT PLATE FOLDABLE ANTENNA MECHANISM

TECHNICAL FIELD

The present invention relates to the technical field of aerospace vehicles, in particular to a bi-directional flat plate foldable unit and a bi-directional flat plate foldable antenna mechanism.

BACKGROUND TECHNOLOGY

With the development of space industry, various types of space foldable structures have been rapidly developed and applied to meet the needs of different space missions. In the face of more complex space missions in the future, the demand for large, high precision, high rigidity, high stability and lightweight space foldable structures is becoming more and more urgent. Due to the space limitation of rocket fairing and the immaturity of spacecraft formation flight and in-orbit assembly technology, the use of folding flat plates to realize the folding and unfolding is a more attractive solution. The foldable mechanism is in the folded state during storage and transportation, and when placed in the working orbit and ready, the drive unit can make it unfold into the intended working state. At present, the application of the foldable mechanism is becoming more and more widespread in all kinds of spacecraft.

The research of the foldable antenna mechanism has become a research hotspot in the world today, and the planar foldable antenna is an important branch of the foldable antenna mechanism. At present, many domestic and foreign research institutions and related scholars have proposed and researched a variety of planar foldable flat plates, but the current planar foldable antennas generally adopt unidirectional folding and unfolding, unable to achieve two orthogonal directions of folding and unfolding, with less support mechanism for the flat plate antenna, and thus the rigidity and stability is poor.

SUMMARY OF THE INVENTION

The object of the present invention is to provide a bi-directional flat plate foldable unit and a bi-directional flat plate foldable antenna mechanism, so as to solve the above-mentioned problems in the prior art and realize the folding and unfolding of a planar antenna with a larger physical diameter and high rigidity.

For achieving the above object, the present invention provides the following solutions:

The present invention provides a bi-directional flat plate foldable unit, comprising: a first row of antenna plates and a second row of antenna plates distributed along a first direction; the first row of antenna plates and the second row of antenna plates both comprising three antenna plates distributed in turn along a second direction, the second direction being perpendicular to the first direction; wherein the three antenna plates in the first row of antenna plates and the three antenna plates in the second row of antenna plates are set opposite each other one by one, any two antenna plates set opposite each other being hinged to each other to form a first rotating pair; wherein any two antenna plates adjacent to each other in the same row of antenna plates are hinged with each other to form a second rotating pair, the first rotating pair having a same axial direction as the second direction and the second rotating pair having a same axial direction as the first direction;

wherein the three antenna plates in the first row of antenna plates and the three antenna plates in the second row of antenna plates are each connected by a vertical support mechanism, and both the vertical support mechanisms are symmetrical about the origin of the bi-directional flat plate foldable unit, the first row of antenna plates being connected to the second row of antenna plates by a lateral support mechanism; the vertical support mechanism is capable of driving any two adjacent antenna plates in the same row of antenna plates to rotate around the first direction and supporting the three antenna plates in the same row of antenna plates after they are fully unfolded, the lateral support mechanism is capable of driving two rows of antenna plates to rotate around the second direction and supporting them after they are fully unfolded.

Preferably, a intermediate antenna plate in the same row of antenna plates is a intermediate antenna plate, another antenna plate in the same row of antenna plates is a first edge-adjacent antenna plate, and another antenna plate in the same row of antenna plates is a second edge-adjacent antenna plate;

the vertical support mechanism comprises a first foldable assembly, a second foldable assembly and a connecting foldable assembly;

the first foldable assembly includes a first compensation plate, one end of the first compensation plate is hinged with a first foldable support rod and a first connecting rod and a second connecting rod respectively hinged at one end with the first edge-adjacent antenna plate, the other end of the first foldable support rod is hinged with one end of the second foldable support rod, the other end of the second foldable support rod is hinged with the first edge-adjacent antenna plate; the other end of the first compensation plate is hinged with a third foldable support rod and a third connecting rod and a fourth connecting rod respectively hinged at one end to the intermediate antenna plate, the other end of the third foldable support rod being hinged to one end of the fourth foldable support rod, the other end of the fourth foldable support rod being hinged to the intermediate antenna plate;

the second foldable assembly comprises a second compensation plate, the second compensation plate being hinged at one end with a fifth connecting rod and a sixth connecting rod hinged at one end respectively to the intermediate antenna plate, the second compensation plate being hinged at the other end with a seventh connecting rods and an eighth connecting rod hinged at one end respectively to the second edge-adjacent antenna plate;

the connecting foldable assembly comprises a first foldable connecting rod and a second foldable connecting rod hinged at one end to one end of the first foldable connecting rod, the other end of the first foldable connecting rod being hinged to the second compensation plate, the other end of the second foldable connecting rod being hinged to the first compensation plate.

Preferably, the lateral support mechanism includes three connecting plates distributed along the first direction and hinged in turn, each the connecting plate is provided with a number of third foldable assembly, the third foldable assembly includes a third compensation plate fixed to the connecting plate, the third compensation plate is hinged at one end with a fifth foldable support rod and a ninth connecting rod, one end of the fifth foldable support rod away from the third compensation plate is hinged to a seventh foldable support rod, the other end of the seventh foldable support rod and one end of the ninth connecting rod away from the third compensation plate are hinged to any one of a row of antenna plates, the other end of the third compensation plate is hinged to a sixth foldable support rod and a tenth connecting rod, one end of the sixth foldable support rod away from the third compensation plate is hinged to an eighth foldable support rod, the other end of the eighth foldable support rod and one end of the tenth connecting rod away from the third compensation plate are each hinged to an antenna plate in another row of antenna plates, and two antenna plates connected to the same the third compensation plate are set opposite to each other.

Preferably, the first foldable support rod and the second foldable support rod, the third foldable support rod and the fourth foldable support rod, the fifth foldable support rod and the seventh foldable support rod, and the sixth foldable support rod and the eighth foldable support rod are respectively hinged by a ninth hinge head and a tenth hinge head containing a locking mechanism; the locking mechanism comprising a locking slot provided on the ninth hinge head and a locking hook provided on the tenth hinge, the locking hook being able to be fastened to the locking slot.

Preferably, two second rotating pairs in the first row of antenna plates or the second row of antenna plates, a rotating pair on the first connecting rod and the first edge-adjacent antenna plate, a rotating pair between the ninth connecting rod and the antenna plate, a rotating pair between the tenth connecting rod and the antenna plate are respectively provided with active driving means, the active driving means being able to drive the corresponding rotating pair to rotate.

Preferably, the axial direction of the hinge axis between the first foldable connecting rod and the second compensation plate, the axial direction of the hinge axis between the second foldable connecting rod and the first compensation plate and the axial direction of the hinge axis between two adjacent connecting plates are perpendicular to the axial direction of the first rotating pair; the axial direction of the hinge axes between the first foldable support rod, the second foldable support rod, the first connecting rod, the second connecting rod, the third connecting rod, the fourth connecting rod and the first compensation plate are all perpendicular to the axial direction of the first rotating pair; the axial direction of the hinge axes between the second foldable support rod, the fourth foldable support rod, the first connecting rod, the second connecting rod, the third connecting rod, the fourth connecting rod and the antenna plate are all perpendicular to the axial direction of the first rotating pair; the axial direction of the hinge axes between the first foldable support rod and the second foldable support rod, the third foldable support rod and the fourth foldable support rod are perpendicular to the axial direction of the first rotating pair; the axial direction of the hinge axes between the fifth connecting rod, the sixth connecting rod, the seventh connecting rod, the eighth connecting rod and the second compensation plate are perpendicular to the axial direction of the first rotating pair; the axial direction of the hinge axes between the fifth connecting rod, the sixth connecting rod, the seventh connecting rod, the eighth connecting rod and the second compensation plate are perpendicular to the axial direction of the first rotating pair; the axial direction of the hinge axes between the fifth connecting rod, the sixth connecting rod, the seventh connecting rod, the eighth connecting rod and the antenna plate are perpendicular to the axial direction of the first rotating pair; the axial direction of any hinge axes in the third foldable assembly is perpendicular to the axial direction of the first rotating pair.

The present invention further provides a bi-directional flat plate foldable antenna mechanism, comprising at least two of the above-mentioned bi-directional flat plate foldable units, two antenna plates set opposite each other at an end of a previous bi-directional flat plate foldable unit serve as two antenna plates set opposite each other at a first end of a next bi-directional flat plate foldable unit; two adjacent connecting plates in two adjacent bi-directional flat plate foldable units are hinged.

Preferably, when all of the bi-directional flat plate foldable units are fully expanded, the axes of the vertical support mechanisms of different bi-directional flat plate foldable units are parallel to each other.

The present invention achieves the following technical effects relative to the prior art:

The bi-directional flat plate foldable unit and bi-directional flat plate foldable antenna mechanism of the present invention facilitate the folding and unfolding of planar antennas with larger physical diameter and high rigidity.

DESCRIPTION OF THE ACCOMPANYING DRAWINGS

To more clearly illustrate the technical solutions in the embodiments of the present invention or in the prior art, the accompanying drawings required in the embodiments will be briefly introduced below. It is apparent that the accompanying drawings in the following description are only some embodiments of the present invention, and other accompanying drawings can be obtained according to these drawings without any creative effort for a person of ordinary skill in the art.

Figure 1:
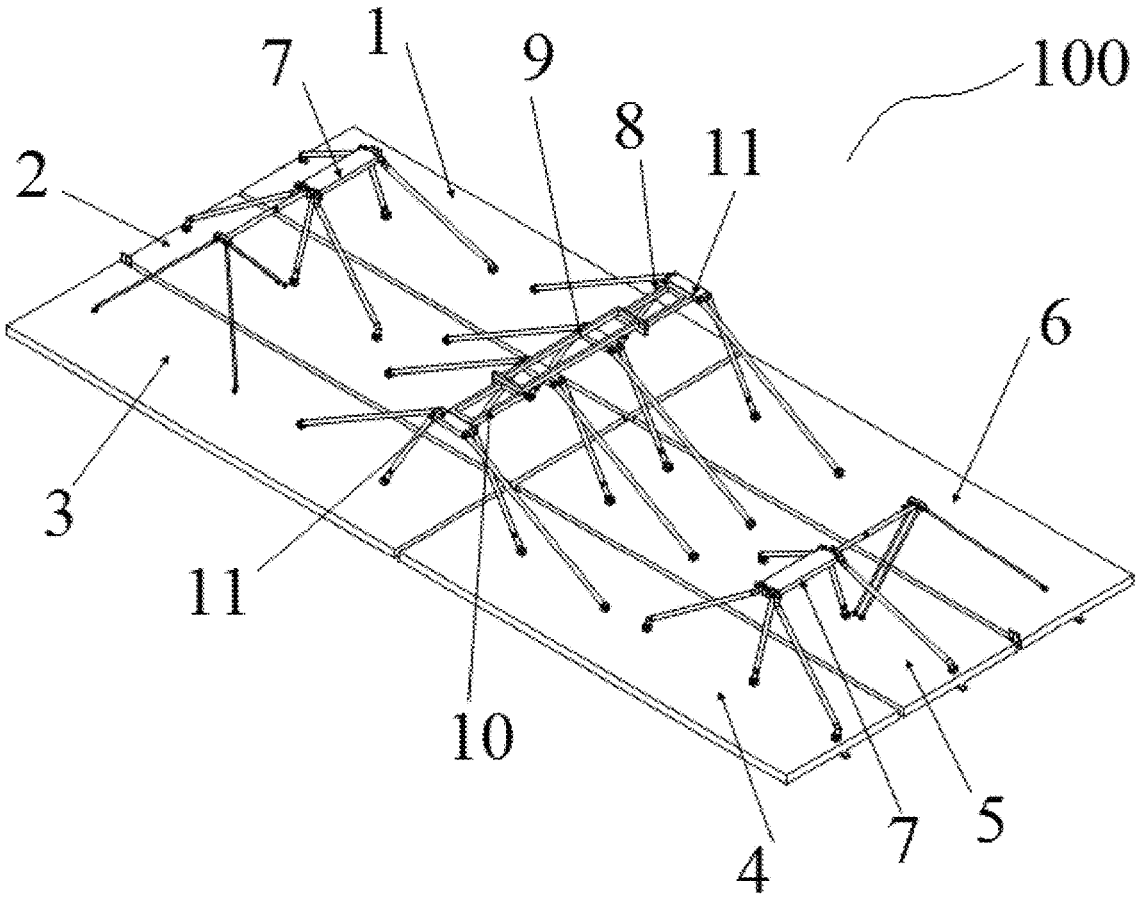
FIG. 1 is a schematic structural diagram I of the bi-directional flat plate foldable unit of the present invention.
Figure 2:
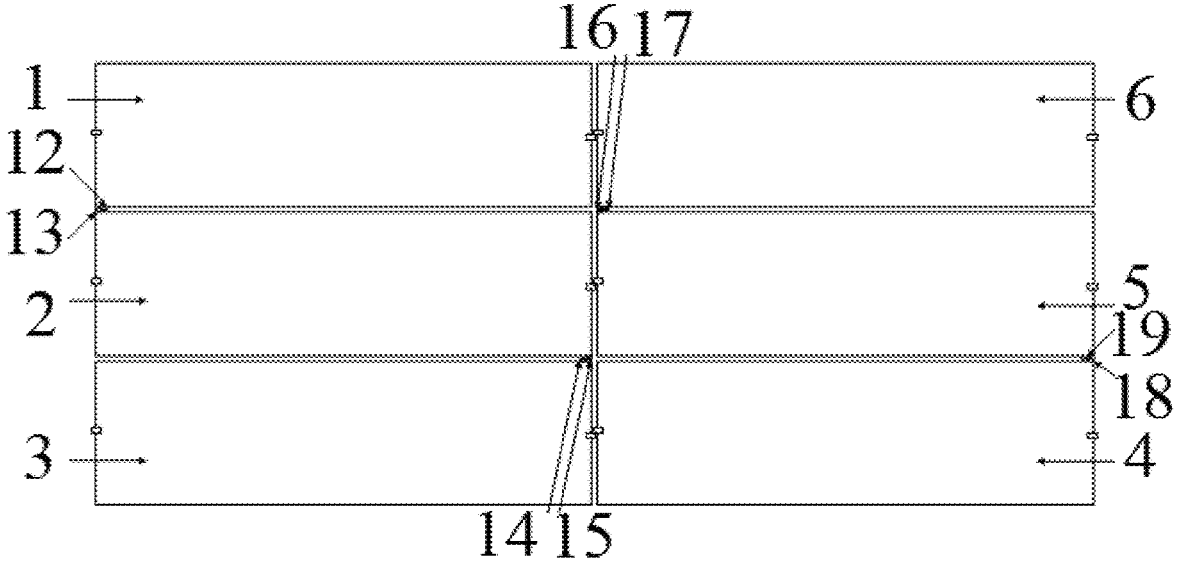
FIG. 2 is a partial schematic structural diagram I of the bi-directional flat plate foldable unit of the present invention.
Figure 3:
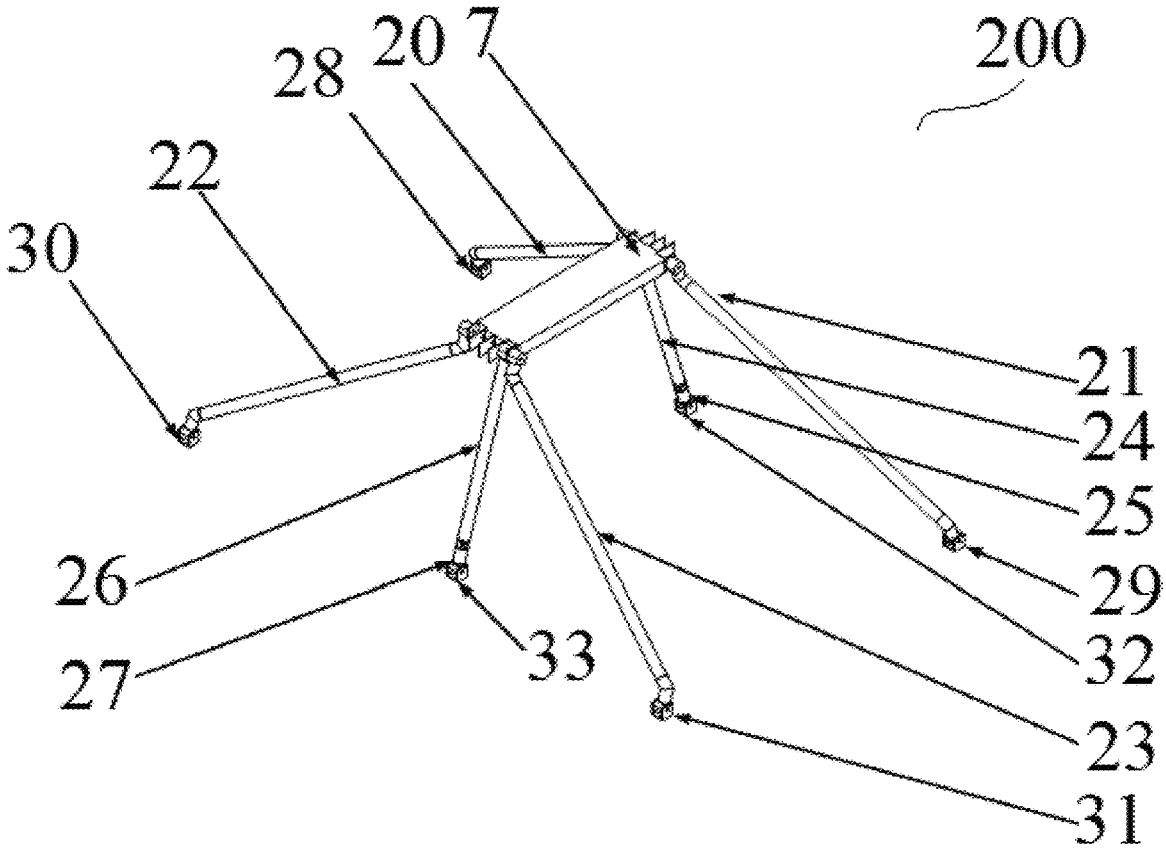
FIG. 3 is a partial schematic structural diagram II of the bi-directional flat plate foldable unit of the present invention.
Figure 4:
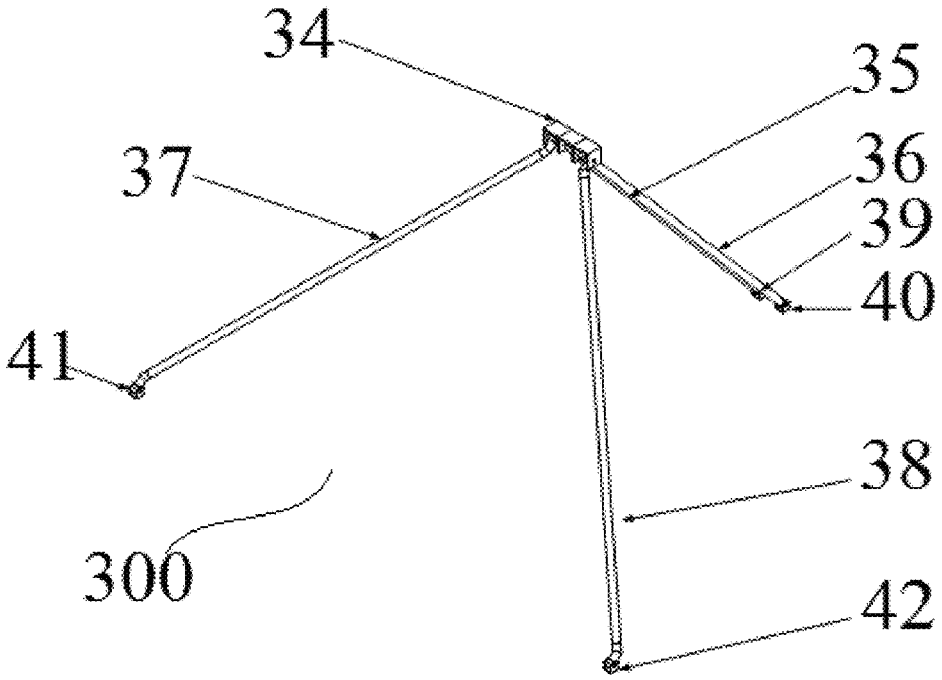
FIG. 4 is a partial schematic structural diagram III of the bi-directional flat plate foldable unit of the present invention.
Figure 5:
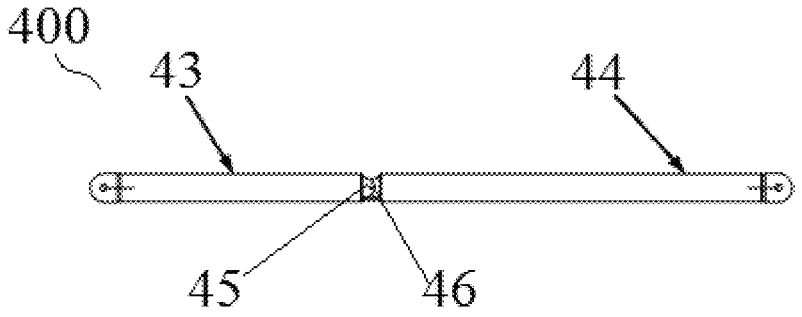
FIG. 5 is a partial schematic structural diagram IV of the bi-directional flat plate foldable unit of the present invention.
Figure 6:
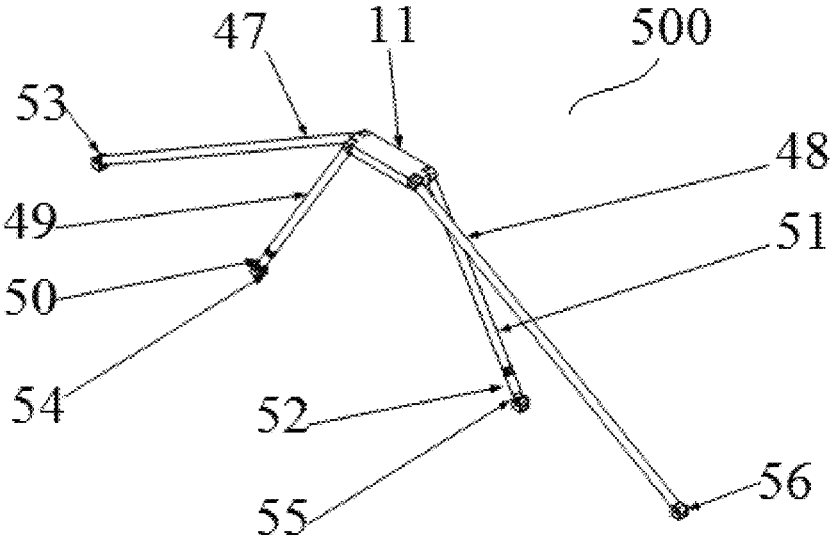
FIG. 6 is a partial schematic structural diagram V of the bi-directional flat plate foldable unit of the present invention.
Figure 7:
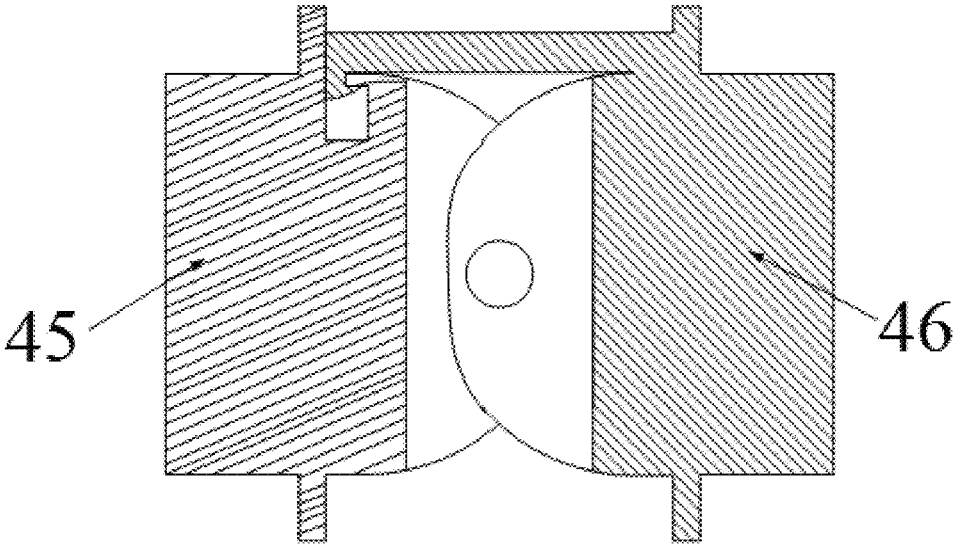
FIG. 7 is a partial schematic structural diagram VI of the bi-directional flat plate foldable unit of the present invention.
Figure 8:
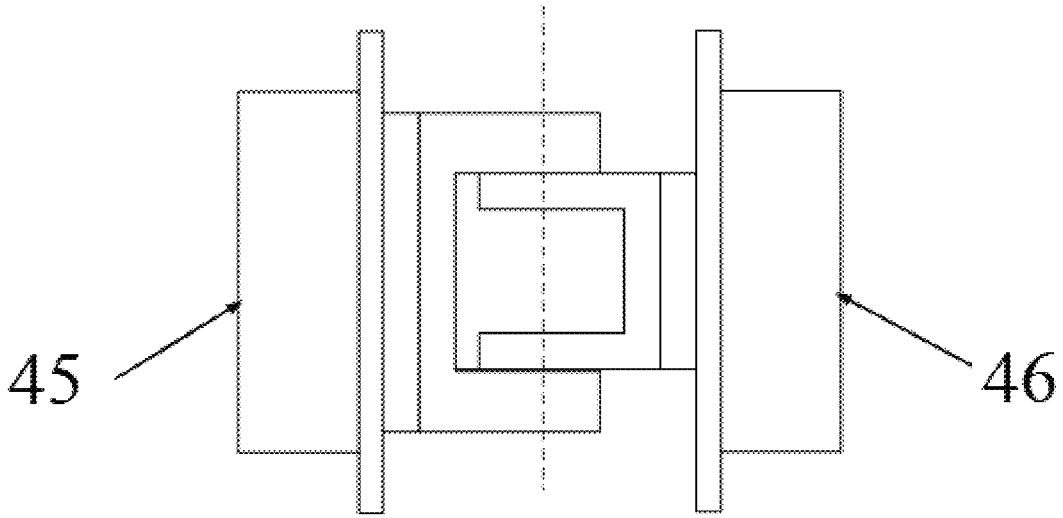
FIG. 8 is a partial schematic structural diagram VII of the bi-directional flat plate foldable unit of the present invention.
Figure 9:
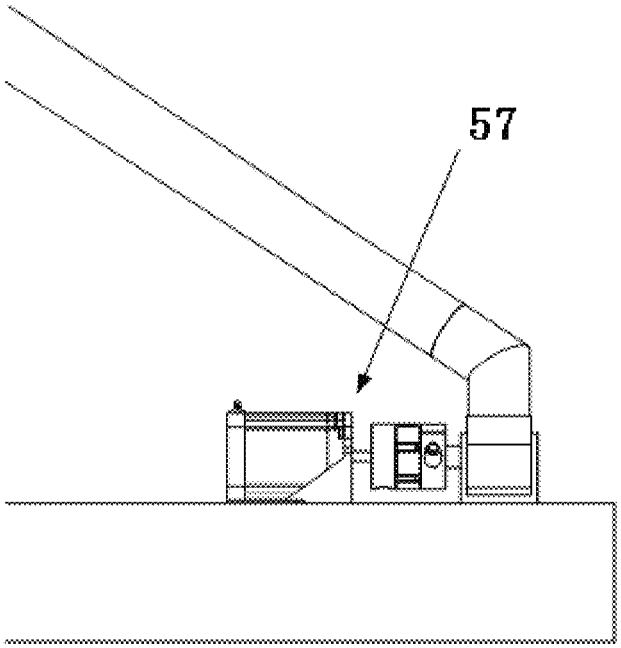
FIG. 9 is a partial schematic structural diagram VIII of the bi-directional flat plate foldable unit of the present invention.
Figure 10:
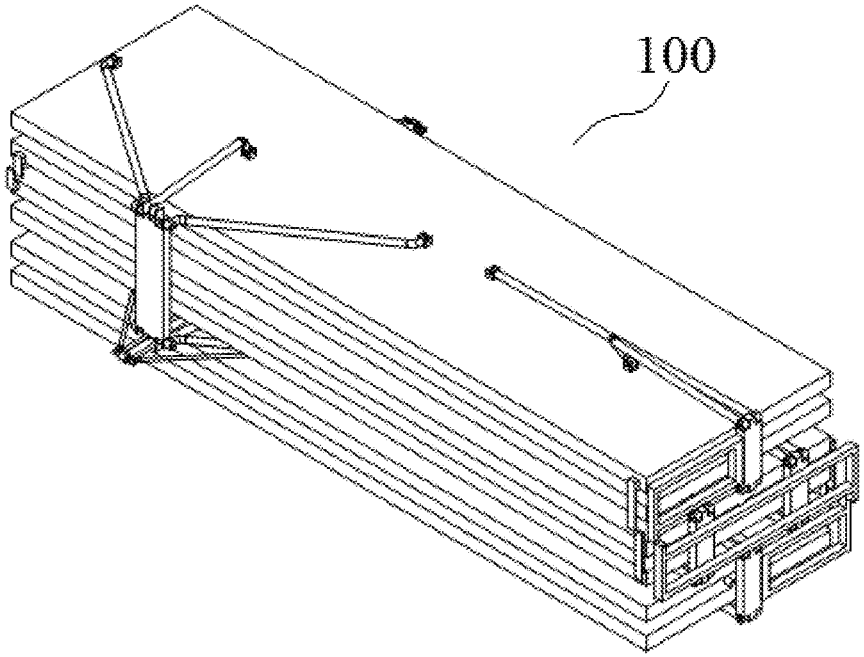
FIG. 10 is a schematic structural diagram II of the bi-directional flat plate foldable unit of the present invention.
Figure 11:
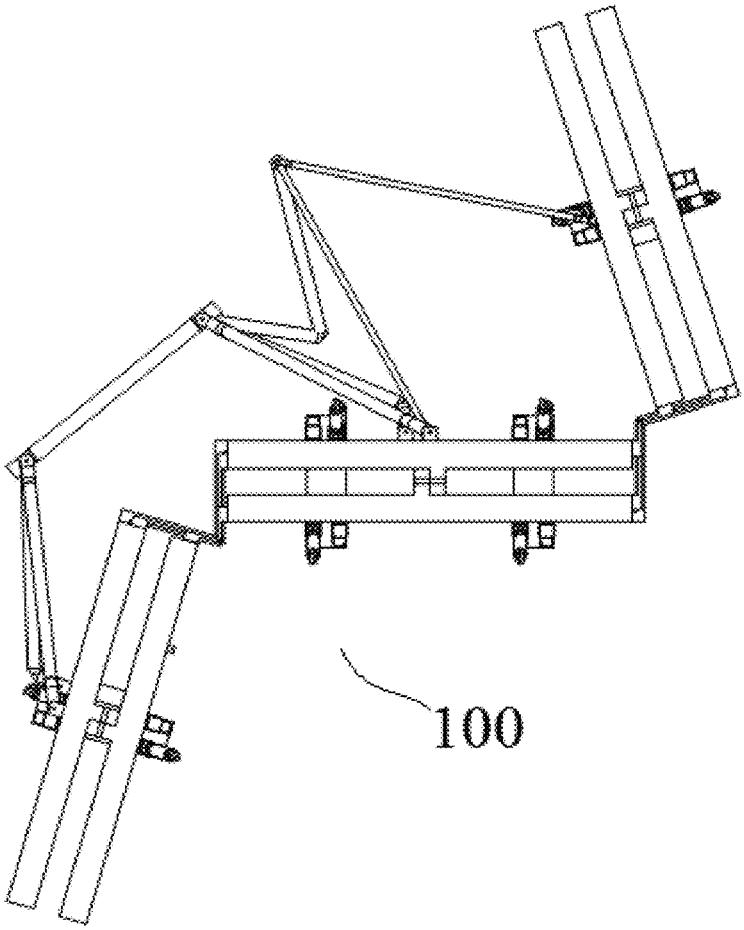
FIG. 11 is a schematic structural diagram III of the bi-directional flat plate foldable unit of the present invention.
Figure 12:
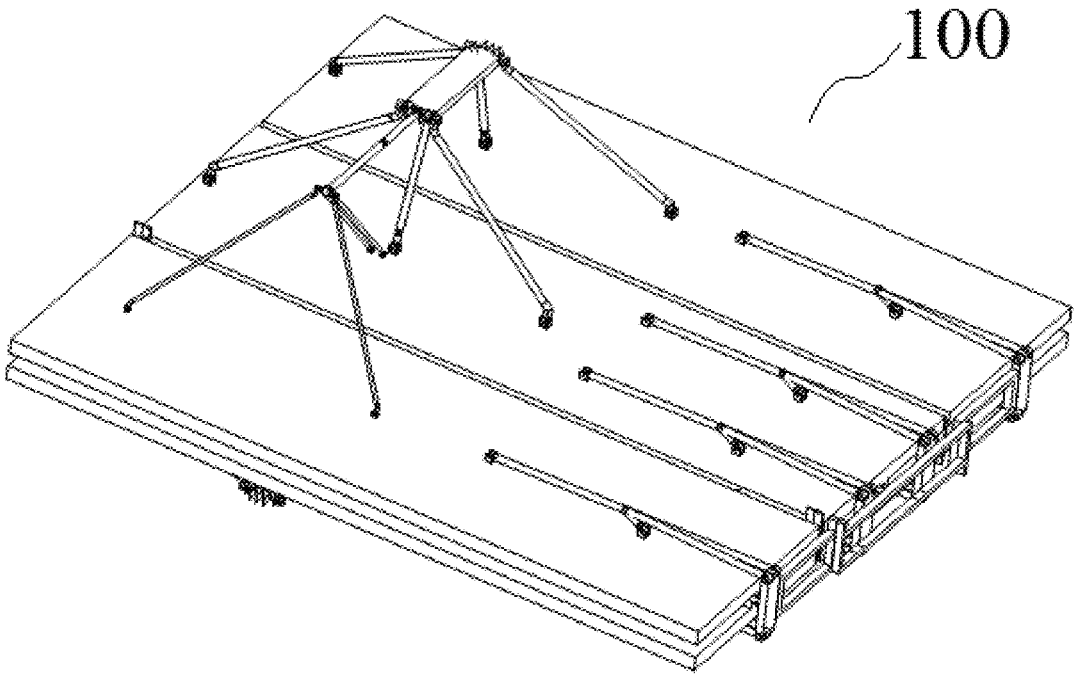
FIG. 12 is a schematic structural diagram IV of the bi-directional flat plate foldable unit of the present invention.
Figure 13:
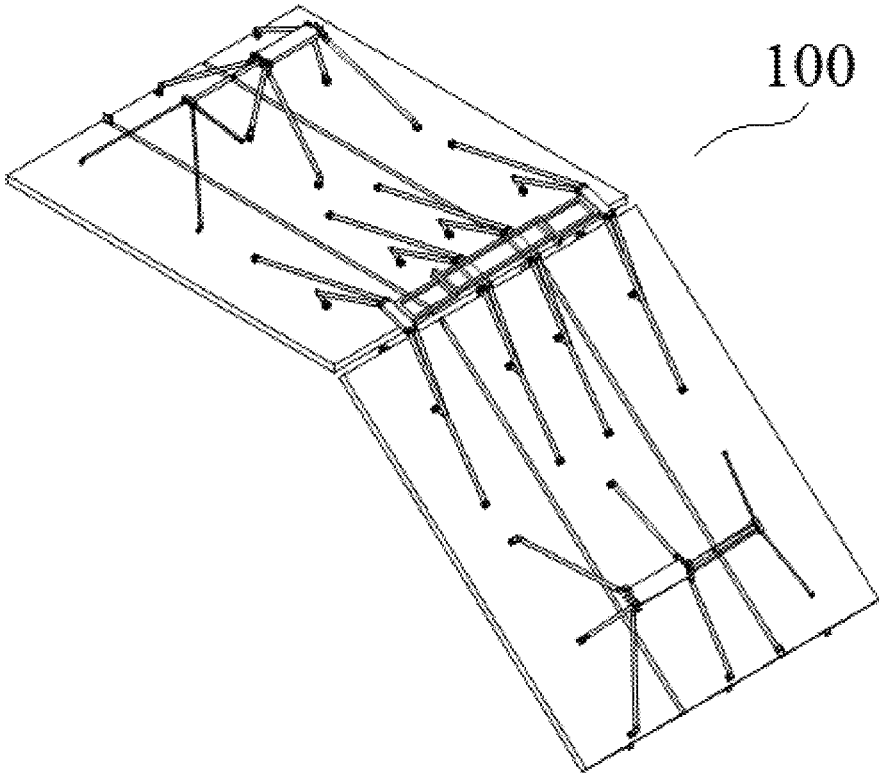
FIG. 13 is a schematic structural diagram V of the bi-directional flat plate foldable unit of the present invention.

Wherein: 100, bi-directional flat plate foldable unit; 200, first foldable assembly; 300, second foldable assembly; 400, connecting foldable assembly; 500, third foldable assembly; 600, bi-directional flat plate foldable antenna mechanism; 1, first antenna plate; 2, second antenna plate; 3, third antenna plate; 4, fourth antenna plate; 5, fifth antenna plate; 6, sixth antenna plate; 7, first compensation plate; 8, first connecting plate; 9, second connecting plate; 10, third connecting plate; 11, third compensation plate; 12, first hinge head; 13, second hinge head; 14, third hinge head; 15, fourth hinge head; 16, fifth hinge head; 17, sixth hinge head; 18, seventh hinge head; 19, eighth hinge head; 20, first connecting rod; 21, second connecting rod; 22, third connecting rod; 23, fourth connecting rod; 24, first foldable support rod; 25, third foldable support rod; 26, second foldable support rod; 27, fourth foldable support rod; 28, first hinge seat; 29, second hinge seat; 30, third hinge seat; 31, fourth hinge seat; 32, fifth hinge seat; 33, sixth hinge seat; 34, second compensation plate; 35. fifth connecting rod; 36, sixth connecting rod; 37, seventh connecting rod; 38, eighth connecting rod; 39, seventh hinge seat; 40, eighth hinge seat; 41, ninth hinge seat; 42, tenth hinge seat; 43, first foldable connecting rod; 44, second foldable connecting rod; 45, ninth hinge head; 46, tenth hinge head; 47, ninth connecting rod; 48, tenth connecting rod; 49, fifth foldable support rod; 50, seventh foldable support rod; 51, sixth foldable support rod; 52, eighth foldable support rod; 53, eleventh hinge seat; 54, twelfth hinge seat; 55, thirteenth hinge seat; 56, fourteenth hinge seat; 57, active driving device.

DETAILED DESCRIPTION OF THE PREFERRED EMBODIMENTS

The technical solutions in the embodiments of the present invention will be clearly and completely described below in conjunction with the accompanying drawings in the embodiments of the present invention. Obviously, the described embodiments are only a part of the embodiments of the present invention, rather than all the embodiments. Based on the embodiments in the present invention, all other embodiments obtained by a person of ordinary skill in the art without creative efforts shall fall within the protection scope of the present invention.

The object of the present invention is to provide a bi-directional flat plate foldable unit and a bi-directional flat plate foldable antenna mechanism, so as to solve the above-mentioned problems of the prior art and realize the folding and unfolding of planar antenna with larger physical diameter and high rigidity.

To make the above object, features and advantages of the present invention more clearly understood, the present invention will be described in further detail below with reference to the accompanying drawings and specific embodiments.

As shown in FIGS. 1 to 13, this embodiment provides a bi-directional flat plate foldable unit 100, including a first row of antenna plates and a second row of antenna plates distributed along a first direction; the first row of antenna plates and the second row of antenna plates both comprising three antenna plates distributed in turn along a second direction, the second direction being perpendicular to the first direction; wherein the three antenna plates in the first row of antenna plates and the three antenna plates in the second row of antenna plates are set opposite each other one by one, any two antenna plates set opposite each other being hinged to each other to form a first rotating pair; wherein any two antenna plates adjacent to each other in the same row of antenna plates are hinged with each other to form a second rotating pair, the first rotating pair having a same axial direction as the second direction and the second rotating pair having a same axial direction as the first direction.

The three antenna plates in the first row of antenna plates and the three antenna plates in the second row of antenna plates are each connected by a vertical support mechanism, and both the vertical support mechanisms are symmetrical about the origin of the bi-directional flat plate foldable unit 100, the first row of antenna plates being connected to the second row of antenna plates by a lateral support mechanism; the vertical support mechanism is capable of driving any two adjacent antenna plates in the same row of antenna plates to rotate around the first direction and supporting the three antenna plates in the same row of antenna plates after they are fully unfolded, the lateral support mechanism is capable of driving two rows of antenna plates to rotate around the second direction and supporting them after they are fully unfolded.

The intermediate antenna plate in the same row of antenna plates is a intermediate antenna plate, another antenna plate in the same row of antenna plates is a first edge-adjacent antenna plate, and another antenna plate in the same row of antenna plates is a second edge-adjacent antenna plate. In this embodiment, the three antenna plates in the first row of antenna plates are the first antenna plate 1, the second antenna plate 2 and the third antenna plate 3; the three antenna plates in the second row of antenna plates are the sixth antenna plate 6, the fifth antenna plate 5 and the fourth antenna plate 4. The second antenna plate 2 and the fifth antenna plate 5 are taken as the intermediate antenna plate; the first antenna plate 1 and the fourth antenna plate 4 are taken as the first edge-adjacent antenna plate; the third antenna plate 3 and the sixth antenna plate 6 are taken as the second edge-adjacent antenna plate. The first antenna plate 1 and the second antenna plate 2 are hinged by the first hinge head 12 and the second hinge head 13 to form the second rotating pair, the second antenna plate 2 and the third antenna plate 3 are hinged by the third hinge head 14 and the fourth hinge head 15 to form the second rotating pair, the fourth antenna plate 4 and the fifth antenna plate 5 are hinged by the seventh hinge head 18 and the eighth hinge head 19 to form the second rotating pair, the fifth antenna plate 5 and the sixth antenna plate 6 are hinged by the fifth hinge head 16 and the sixth hinge head 17 to form the second rotating pair.

The vertical support mechanism includes a first foldable assembly 200, a second foldable assembly 300 and a connecting foldable assembly 400; the first foldable assembly 200 includes a first compensation plate 7, one end of the first compensation plate 7 is hinged with a first foldable support rod 24 and a first connecting rod 20 and a second connecting rod 21 hinged at one end respectively to the first edge-adjacent antenna plate, the first connecting rod 20 is hinged with the first hinge seat 28 on the first edge-adjacent antenna plate, the second connecting rod 21 is hinged to the second hinge seat 29 on the first edge-adjacent antenna plate, the other end of the first foldable support rod 24 is hinged to one end of the second foldable support rod 26, the other end of the second foldable support rod 26 is hinged to the fifth hinge seat 32 on the first edge-adjacent antenna plate; the other end of the first compensation plate 7 is hinged with the third foldable support rod 25 and the third connecting rod 22 and the fourth connecting rod 23 respectively hinged at one end to the intermediate antenna plate, the third connecting rod 22 is hinged to the third hinge seat 30 on the intermediate antenna plate and the fourth connecting rod 23 is hinged with the fourth hinge seat 31 on the intermediate antenna plate; the other end of the third foldable support rod 25 is hinged with one end of the fourth foldable support rod 27, and the other end of the fourth foldable support rod 27 is hinged with the sixth hinged seat 33 on the first edge-adjacent antenna plate.

The second foldable assembly 300 includes a second compensation plate 34, one end of the second compensation plate 34 is hinged with a fifth connecting rod 35 and a sixth connecting rod 36 hinged at one end respectively with the intermediate antenna plate, the fifth connecting rod 35 is hinged with a seventh hinge seat 39 on the intermediate antenna plate, the sixth connecting rod 36 is hinged with an eighth hinge seat 40 on the intermediate antenna plate; the other end of the second compensation plate 34 is hinged with a seventh connecting rod 37 and an eighth connecting rod 38 hinged at one end respectively with the second edge-adjacent antenna plate, the seventh connecting rod 37 is hinged with the ninth hinge seat 41 on the intermediate antenna plate, and the eighth connecting rod 38 is hinged with the tenth hinge seat 42 on the intermediate antenna plate.

The connecting foldable assembly 400 includes a first foldable connecting rod 43 and a second foldable connecting rod 44 hinged at one end to one end of the first foldable connecting rod 43, the other end of the first foldable connecting rod 43 is hinged to the second compensation plate 34, and the other end of the second foldable connecting rod 44 is hinged to the first compensation plate 7.

The lateral support mechanism includes three connecting plates distributed in the first direction and hinged in turn, namely the first connecting plate 8, the second connecting plate 9 and the third connecting plate 10, each connecting plate is provided with a number of third foldable assembly 500, the third foldable assembly 500 includes a third compensation plate 11 fixedly connected with the connecting plate, one end of the third compensation plate 11 is hinged with the fifth foldable support rod 49 and the ninth connecting rod 47, the end of the ninth connecting rod 47 away from the third compensation plate 11 is hinged to the eleventh hinge seat 53 on the antenna plate, the end of the fifth foldable support rod 49 away from the third compensation plate 11 is hinged to the seventh foldable support rod 50, and the other end of the seventh foldable support rod 50 is hinged to the twelfth hinge seat 54 on the antenna plate. The other end of the third compensation plate 11 is hinged with the sixth foldable support rod 51 and the tenth connecting rod 48, the end of the tenth connecting rod 48 away from the third compensation plate 11 is hinged with the thirteenth hinge seat 55 on the antenna plate, the end of the sixth foldable support rod 51 away from the third compensation plate 11 is hinged with the eighth foldable support rod 52, the other end of the eighth foldable support rod 52 is hinged with the fourteenth hinge seat 56 on the antenna plate; the ninth connecting rod 47 and the seventh foldable support rod 50 are hinged with the same antenna plate, the tenth connecting rod 48 and the eighth foldable support rod 52 are hinged to the same antenna plate, and the two antenna plates connected to the same third compensation plate 11 are set opposite to each other.

The first foldable support rod 24 and the second foldable support rod 26, the third foldable support rod 25 and the fourth foldable support rod 27, the fifth foldable support rod 49 and the seventh foldable support rod 50, and the sixth foldable support rod 51 and the eighth foldable support rod 52 are hinged respectively by the ninth hinge head 45 and the tenth hinge head 46 containing the locking mechanism; the locking mechanism includes a locking slot set on the ninth hinge head 45 and a locking hook set on the tenth hinge head 46, the locking hook can be fastened on the locking slot, and a certain impact is required to make the locking hook cross the highest point of the locking slot to realize the locking. When the locking hook is fastened on the locking slot, the locking hook is no longer separated from the locking slot to maintain each antenna plate in the unfolded state.

The two second rotating pairs in the first row of antenna plates or the second row of antenna plates, the rotating pair between the first connecting rod 20 and the first hinge seat 28 on the first edge-adjacent antenna plate, the rotating pair between the end of the ninth connecting rod 47 away from the third compensation plate 11 and the eleventh hinge seat 53 on the antenna plate, and the rotating pair between the end of the tenth connecting rod 48 away from the third compensation plate 11 and the thirteenth hinge seat 56 on the antenna plate are respectively provided with active driving devices 57 which are able to drive the corresponding rotating pairs to rotate. Specifically, the active driving devices 57 use electric motors, and the output shafts of the active driving devices 57 are connected to the rotating shafts of the rotating pairs via a coupling, and the rotating pairs rotate when the active driving devices 57 drive the rotating shafts.

The axial direction of the hinge axis between the first foldable connecting rod 43 and the second compensation plate 34, the axial direction of the hinge axis between the second foldable connecting rod 44 and the first compensation plate 7 and the axial direction of the hinge axis between the two adjacent connecting plates are perpendicular to the axial direction of the first rotating pair; the axial direction of the hinge axis between the first foldable support rod 24, the second foldable support rod 26, the first connecting rod 20, the second connecting rod 21, the third connecting rod 22, the fourth connecting rod 23 and the first compensation plate 7 are all perpendicular to the axial direction of the first rotating pair. The axial direction of the hinge axis between the second foldable support rod 26, the fourth foldable support rod 27, the first connecting rod 20, the second connecting rod 21, the third connecting rod 22, the fourth connecting rod 23 and the antenna plate are all perpendicular to the axial direction of the first rotating pair. The axial direction of the hinge axis between the first foldable support rod 24 and the second foldable support rod 26, and the hinge axis between the third foldable support rod 25 and the fourth foldable support rod 27 are all perpendicular to the axial direction of the first rotating pair. The axial direction of the hinge axis between the fifth connecting rod 35, the sixth connecting rod 36, the seventh connecting rod 37, the eighth connecting rod 38 and the second compensation plate 34 are all perpendicular to the axial direction of the first rotating pair. The axial direction of the hinge axis between the fifth connecting rod 35, the sixth connecting rod 36, the seventh connecting rod 37, the eighth connecting rod 38 and the antenna plate are all perpendicular to the axial direction of the first rotating pair. The axial direction of any hinge axis of the third foldable assembly 500 are perpendicular to the axial direction of the first rotating pair.

When the six antenna plates are fully unfolded, the first foldable assembly 200 is "trapezoidal" and connected with the second foldable assembly 300 as "triangular" by the connecting foldable assembly 400, and the third foldable assembly 500 is "trapezoidal". When the six antenna plates are completely folded, the folding direction of the first foldable assembly 200, the second foldable assembly 300 and the connecting foldable assembly 400 is perpendicular to the direction of the axis of the first rotating pair; the folding direction of the third foldable assembly 500 is parallel to the direction of the axis of the first rotating pair. In this embodiment, the structure of the six antenna plates is identical. As can be seen above, the folding direction of the first vertical support mechanism is exactly parallel to the vertical folding direction of the antenna plate, and the folding direction of the lateral support mechanism is exactly parallel to the lateral folding direction of the antenna plate, which improves the support rigidity and further enhances the structural stability of the unit structure when unfolding.

When the six antenna plates are fully unfolded, the two vertical support mechanisms and the lateral support mechanism of the bi-directional flat plate foldable unit are square frustum structure. That is, in the fully unfolded state, the projections of the two vertical support mechanisms and the lateral support mechanism are trapezoidal.

Figure 14:
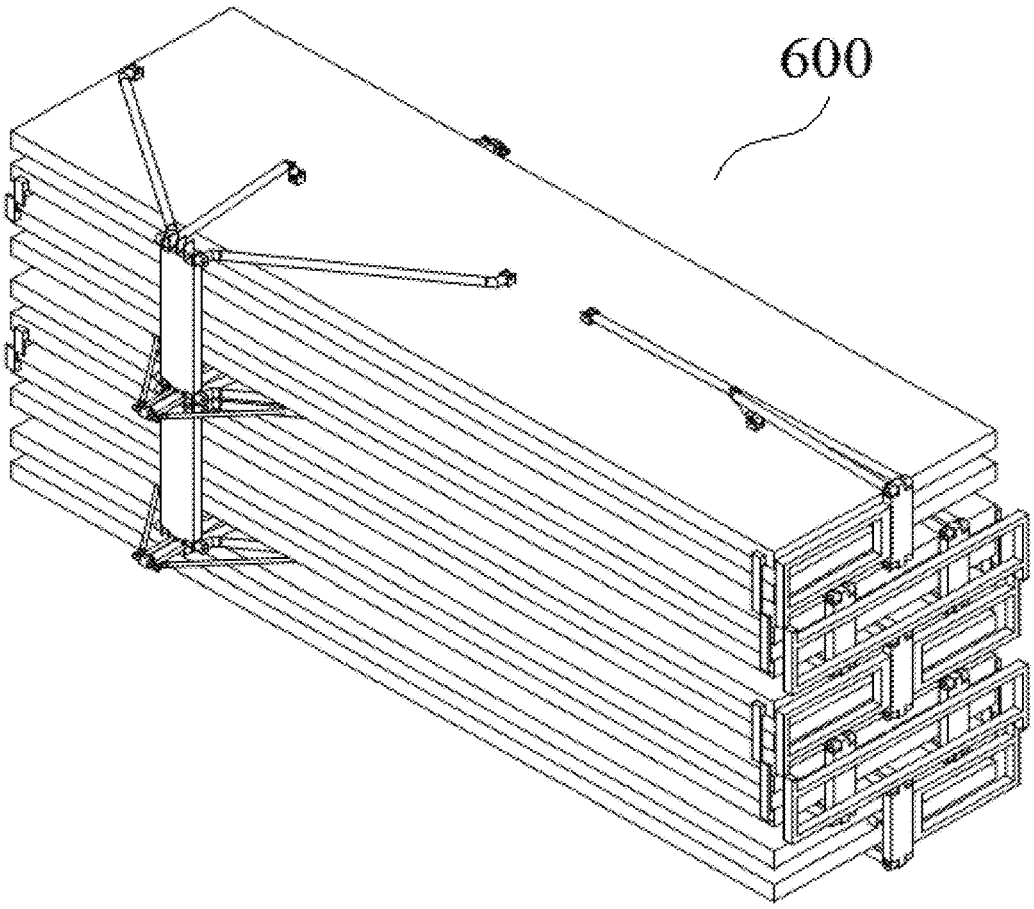
FIG. 14 is a schematic structural diagram I of the bi-directional flat plate foldable antenna mechanism of the present invention.
Figure 15:
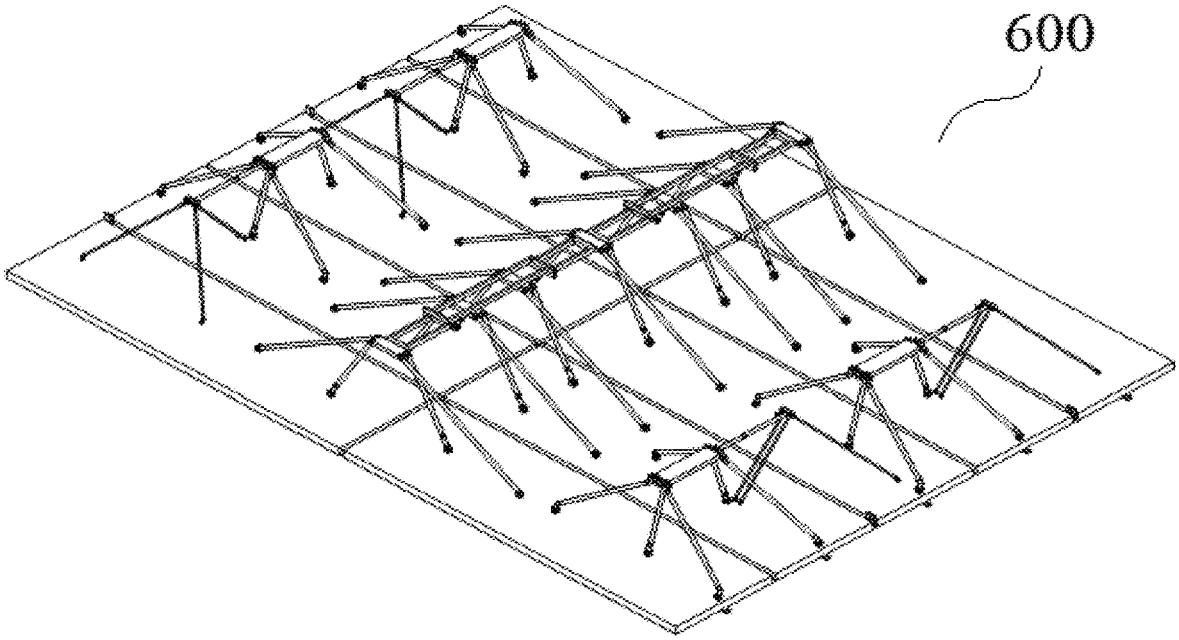
FIG. 15 is a schematic structural diagram II of the bi-directional flat plate foldable antenna mechanism of the present invention.

As shown in FIGS. 14 to 15, this embodiment also provides a bi-directional flat plate foldable antenna mechanism 600, including two aforementioned bi-directional flat plate foldable units 100, two antenna plates set opposite each other at an end of a previous bi-directional flat plate foldable unit 100 serve as two antenna plates set opposite each other at a first end of a next bi-directional flat plate foldable unit 100; two adjacent connecting plates in two adjacent bi-directional flat plate foldable units 100 are hinged. When all of the bi-directional flat plate foldable units 100 are fully expanded, the axes of the vertical support mechanisms of different bi-directional flat plate foldable units 100 are parallel to each other. It should be noted that the specific number of the bi-directional flat plate foldable unit 100 in the bi-directional flat plate foldable antenna mechanism 600 is not limited to this embodiment, in the specific application of the bi-directional flat plate foldable antenna mechanism 600 may contain three or even more bi-directional flat plate foldable unit 100, the interconnection of multiple bi-directional flat plate foldable units 100 is the same as that of the present embodiment, which will not be repeated here.

In the description of the present invention, it should be noted that the terms "first" and "second" are used for descriptive purposes only, and should not be understood as indicating or implying relative importance.

In this specification, specific examples are used to illustrate the principles and implementations of the present invention, and the descriptions of the above embodiments are only used to help understand the method and the core idea of the present invention. Meanwhile, for those skilled in the art, according to the idea of the present invention, there will be changes in the specific embodiments and application scope. In conclusion, the contents of this specification should not be construed as limiting the present invention.

What is claimed is:

1. A bi-directional flat plate foldable unit, comprising: a first row of antenna plates and a second row of antenna plates distributed along a first direction; the first row of antenna plates and the second row of antenna plates both comprising three antenna plates distributed in turn along a second direction, the second direction being perpendicular to the first direction; wherein the three antenna plates in the first row of antenna plates and the three antenna plates in the second row of antenna plates are set opposite each other one by one, any two antenna plates set opposite each other being hinged to each other to form a first rotating pair; wherein any two antenna plates adjacent to each other in the same row of antenna plates are hinged with each other to form a second rotating pair, the first rotating pair having a same axial direction as the second direction and the second rotating pair having a same axial direction as the first direction;

wherein the three antenna plates in the first row of antenna plates and the three antenna plates in the second row of antenna plates are each connected by a vertical support mechanism, and both the vertical support mechanisms are symmetrical about the origin of the bi-directional flat plate foldable unit, the first row of antenna plates being connected to the second row of antenna plates by a lateral support mechanism; the vertical support mechanism is capable of driving any two adjacent antenna plates in the same row of antenna plates to rotate around the first direction and supporting the three antenna plates in the same row of antenna plates after they are fully unfolded, the lateral support mechanism is capable of driving two rows of antenna plates to rotate around the second direction and supporting them after they are fully unfolded;

wherein an intermediate antenna plate in the same row of antenna plates is a an intermediate antenna plate, another antenna plate in the same row of antenna plates is a first edge-adjacent antenna plate, and another antenna plate in the same row of antenna plates is a second edge-adjacent antenna plate;

wherein the vertical support mechanism comprises a first foldable assembly, a second foldable assembly and a connecting foldable assembly;

wherein the first foldable assembly includes a first compensation plate, one end of the first compensation plate is hinged with a first foldable support rod and a first connecting rod and a second connecting rod respectively hinged at one end with the first edge-adjacent antenna plate, the other end of the first foldable support rod is hinged with one end of the second foldable support rod, the other end of the second foldable support rod is hinged with the first edge-adjacent antenna plate; the other end of the first compensation plate is hinged with a third foldable support rod and a third connecting rod and a fourth connecting rod respectively hinged at one end to the intermediate antenna plate, the other end of the third foldable support rod being hinged to one end of the fourth foldable support rod, the other end of the fourth foldable support rod being hinged to the intermediate antenna plate;

wherein the second foldable assembly comprises a second compensation plate, the second compensation plate being hinged at one end with a fifth connecting rod and a sixth connecting rod hinged at one end respectively to the intermediate antenna plate, the second compensation plate being hinged at the other end with a seventh connecting rods and an eighth connecting rod hinged at one end respectively to the second edge-adjacent antenna plate;

wherein the connecting foldable assembly comprises a first foldable connecting rod and a second foldable connecting rod hinged at one end to one end of the first foldable connecting rod, the other end of the first foldable connecting rod being hinged to the second compensation plate, the other end of the second foldable connecting rod being hinged to the first compensation plate.

2. The bi-directional flat plate foldable unit according to claim 1, wherein the lateral support mechanism includes three connecting plates distributed along the first direction and hinged in turn, each of the connecting plates is provided with a number of third foldable assembly, the third foldable assembly includes a third compensation plate fixed to the connecting plate, the third compensation plate is hinged at one end with a fifth foldable support rod and a ninth connecting rod, one end of the fifth foldable support rod away from the third compensation plate is hinged to a seventh foldable support rod, the other end of the seventh foldable support rod and one end of the ninth connecting rod away from the third compensation plate are hinged to any one of a row of antenna plates, the other end of the third compensation plate is hinged to a sixth foldable support rod and a tenth connecting rod, one end of the sixth foldable support rod away from the third compensation plate is hinged to an eighth foldable support rod, the other end of the eighth foldable support rod and one end of the tenth connecting rod away from the third compensation plate are each hinged to an antenna plate in another row of antenna plates, and two antenna plates connected to the same the third compensation plate are set opposite to each other.

3. The bi-directional flat plate foldable unit according to claim 2, wherein the first foldable support rod and the second foldable support rod, the third foldable support rod and the fourth foldable support rod, the fifth foldable support rod and the seventh foldable support rod, and the sixth foldable support rod and the eighth foldable support rod are respectively hinged by a ninth hinge head and a tenth hinge head containing a locking mechanism; the locking mechanism comprising a locking slot provided on the ninth hinge head and a locking hook provided on the tenth hinge, the locking hook being able to be fastened to the locking slot.

4. The bi-directional flat plate foldable unit according to claim 2, wherein two second rotating pairs in the first row of antenna plates or the second row of antenna plates, a rotating pair on the first connecting rod and the first edge-adjacent antenna plate, a rotating pair between the ninth connecting rod and the antenna plate, a rotating pair between the tenth connecting rod and the antenna plate are respectively provided with active driving means, the active driving means being able to drive the corresponding rotating pair to rotate.

5. The bi-directional flat plate foldable unit according to claim 2, wherein the axial direction of the hinge axis between the first foldable connecting rod and the second compensation plate, the axial direction of the hinge axis between the second foldable connecting rod and the first compensation plate and the axial direction of the hinge axis between two adjacent connecting plates are perpendicular to the axial direction of the first rotating pair; the axial direction of the hinge axes between the first foldable support rod, the second foldable support rod, the first connecting rod, the second connecting rod, the third connecting rod, the fourth connecting rod and the first compensation plate are all perpendicular to the axial direction of the first rotating pair; the axial direction of the hinge axes between the second foldable support rod, the fourth foldable support rod, the first connecting rod, the second connecting rod, the third connecting rod, the fourth connecting rod and the antenna plate are all perpendicular to the axial direction of the first rotating pair; the axial direction of the hinge axes between the first foldable support rod and the second foldable support rod, the third foldable support rod and the fourth foldable support rod are perpendicular to the axial direction of the first rotating pair; the axial direction of the hinge axes between the fifth connecting rod, the sixth connecting rod, the seventh connecting rod, the eighth connecting rod and the second compensation plate are perpendicular to the axial direction of the first rotating pair; the axial direction of the hinge axes between the fifth connecting rod, the sixth connecting rod, the seventh connecting rod, the eighth connecting rod and the second compensation plate are perpendicular to the axial direction of the first rotating pair; the axial direction of the hinge axes between the fifth connecting rod, the sixth connecting rod, the seventh connecting rod, the eighth connecting rod and the antenna plate are perpendicular to the axial direction of the first rotating pair; the axial direction of any hinge axes in the third foldable assembly is perpendicular to the axial direction of the first rotating pair.

6. A bi-directional flat plate foldable antenna mechanism, comprising at least two bi-directional flat plate foldable units as claimed in claim 1, two antenna plates set opposite each other at an end of a previous bi-directional flat plate foldable unit serve as two antenna plates set opposite each other at a first end of a next bi-directional flat plate foldable unit; two adjacent connecting plates in two adjacent bi-directional flat plate foldable units are hinged.

7. The bi-directional flat plate foldable antenna mechanism according to claim 6, wherein when all of the bi-directional flat plate foldable units are fully expanded, the axes of the vertical support mechanisms of different bi-directional flat plate foldable units are parallel to each other.

* * * * *